US005406754A

United States Patent [19]

Cosby

[11] Patent Number: 5,406,754

[45] Date of Patent: Apr. 18, 1995

[54] DRAIN GUTTER DEBRIS GUARD AND METHOD OF MAKING

[76] Inventor: Lloyd N. Cosby, 5413 Waycross Dr., Alexandria, Va. 22310

[21] Appl. No.: 12,636

[22] Filed: Feb. 3, 1993

[51] Int. Cl.[6] ..... E04D 13/00

[52] U.S. Cl. ..... 52/12

[58] Field of Search ..... 52/12

[56] References Cited

U.S. PATENT DOCUMENTS 474,442 5/1882 Byers .
877,456 1/1908 Sander .
3,507,396 7/1967 Homa .
4,553,357 11/1985 Pepper .
4,769,957 11/1988 Knowles .
4,841,686 6/1989 Rees .
4,959,932 10/1990 Pfeifer ..... 52/12
4,965,969 10/1990 Artenen ..... 52/12

*Primary Examiner*—Carl D. Friedman
*Assistant Examiner*—Christopher Todd Kent
*Attorney, Agent, or Firm*—William L. Klima

[57] ABSTRACT

An improved gutter guard comprising a fine screen support by a structural stiffening matrix support. The fine screen prevents the penetration of even fine debris while the stiffening matrix support strengthens the fine screen against bending in order to bridge the opening of a conventional gutter.

12 Claims, 2 Drawing Sheets

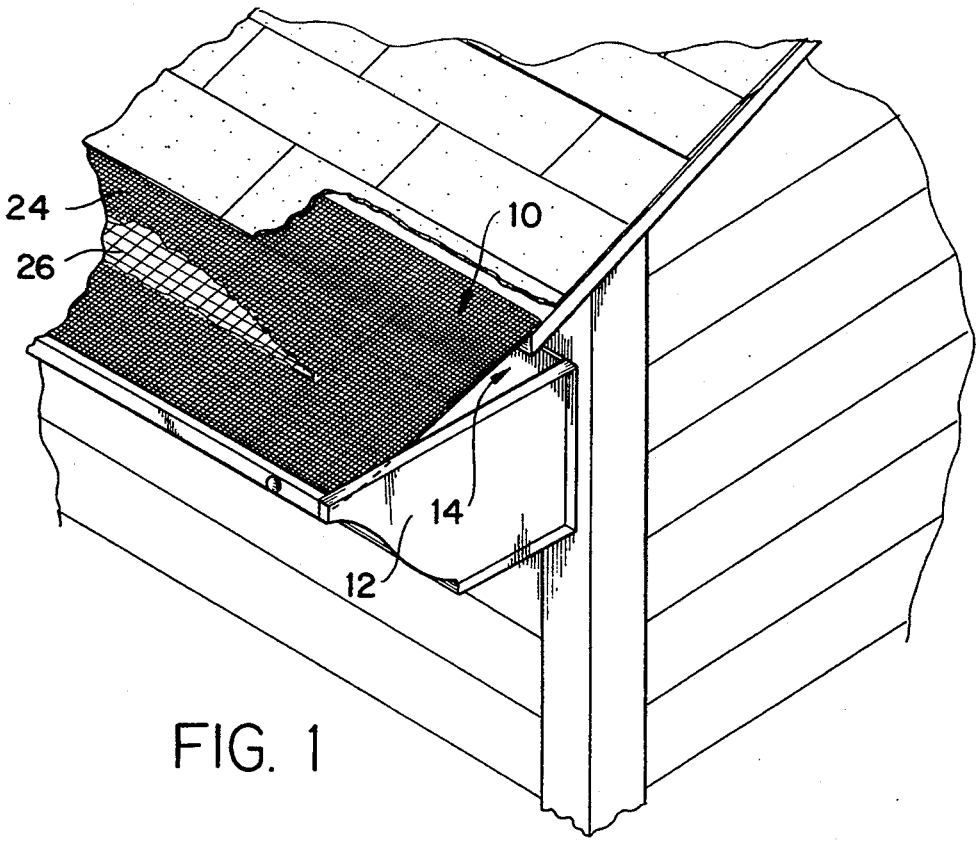
FIG. 1
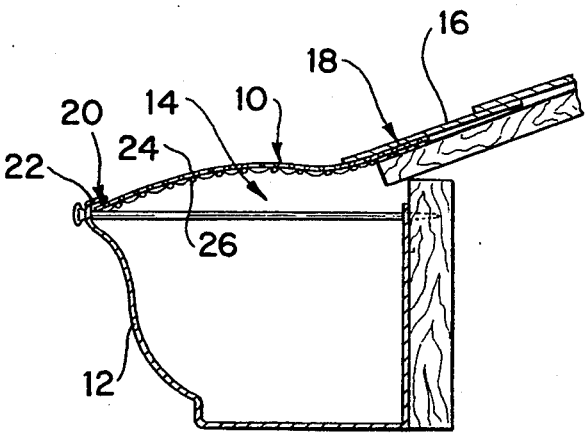
FIG. 2
FIG. 3
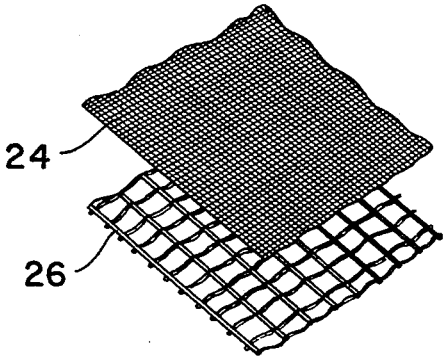
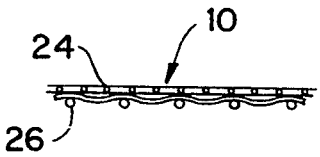
FIG. 4

FIG. 5
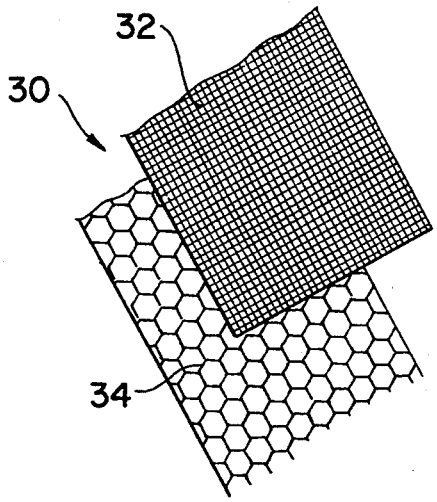
FIG. 7
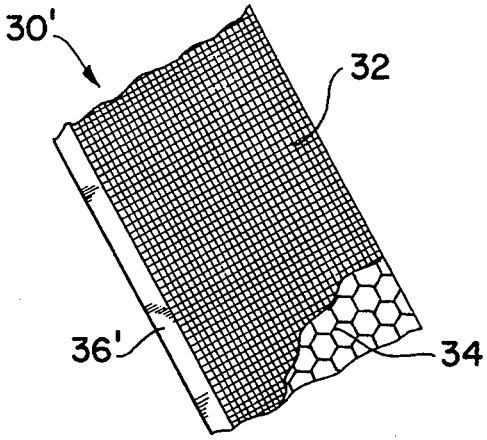
FIG. 6
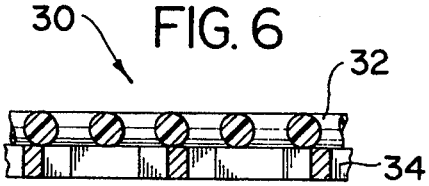
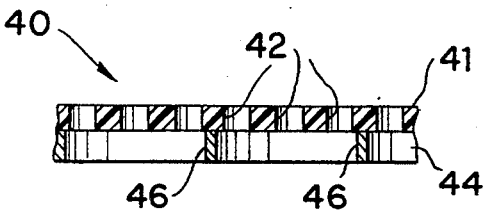
FIG. 8A
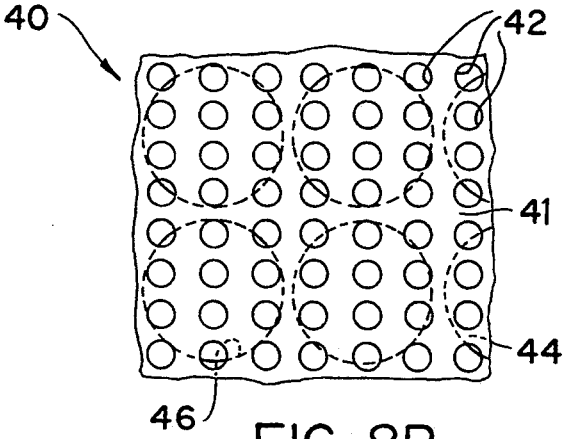
FIG. 8B
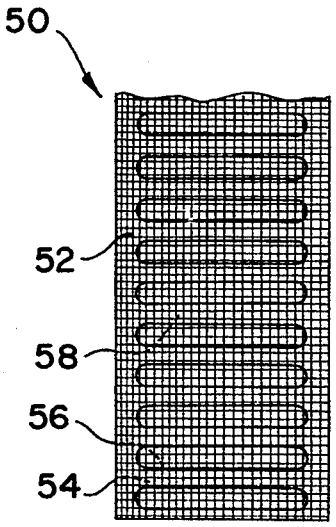
FIG. 9

DRAIN GUTTER DEBRIS GUARD AND METHOD OF MAKING

BACKGROUND OF THE INVENTION

1. Field of the Invention

The present invention is directed to a drain gutter debris guard to be installed on conventional gutter to prevent leaves, tree needles, bark and other debris from entering and clogging the gutter. Further, the present invention includes a method of making the drain gutter debris guard according to the present invention.

2. Prior Art

Gutters are for collecting rain water flowing off the roof and to direct the water away from the foundation of the building. The clogging of gutters is a leading cause of wet basements and crawl spaces in houses. Gutter cleaning must be done periodically to prevent blockages that impede the flow of water. Many soils with high moisture content expand fully when wet and shrink when dry, exerting pressure on the foundation that can cause them to crack and leak.

Clogged gutters fill up with water exerting heavy weight at the midpoint between downspouts causing the gutters to sag and thereby reversing the normal drainage slope. Standing water, rotting leaves and trapped debris in the gutters produce corrosive acids causing damage to the gutters, roof and building fascia and soffit.

Gutter cleaning is hazardous, especially for elderly people. The customary way to clean gutters is by hand with a ladder from below or on the roof above. There are a number of relatively new systems for cleaning leaves out of gutters such as air blowers or vacuum devices, water pressure hoses, and mechanical snakes to get the trapped debris out of the downspouts.

The solution to all of these problems is to prevent leaves, tree needles, seeds, bark and other outdoor type debris from ever entering the drain gutter.

There exists a number of drain gutter guards that are available on the market and/or have been patented. Some of these guards use a screen or mesh type material to cover the upper opening into the conventional drain gutter to prevent debris from entering the drain gutter while allowing rain water to drain from the roof into the drain gutter. These types of guards provide initial protection when first installed in preventing larger debris, particularly leaves, from entering the drain gutter. However, smaller size debris such as tree needles, particles of barks, deteriorate leaves, fall leaf chips, spring tree blossoms, twigs and other debris measuring less than a quarter inch tend to penetrate through many of the guards using larger mesh size and eventually clod the drain gutter. In order to alleviate the problem, the guard must be removed from the gutter to get at the debris for removal. This is a bothersome chore for a homeowner and a continuing source of frustration.

Further, with time, smaller debris that is still too large to penetrate fully through the guard but small enough to begin penetrating the larger mesh of the guard becomes trapped and eventually clods the guard preventing the entry of water into the drain gutter and defeating the primary functioning of the drain gutter.

Some attempts have been made to reduce the mesh size of the material used in constructing the guards, however, the structural strength of this material with respect to bending greatly decreases with decreasing mesh size requiring structural supporting or stiffening in order to bridge the dimension of the opening of the conventional drain gutter. For example, U.S. Pat. No. 4,769,957 to Knowles, discloses a gutter guard utilizing a metal frame for supporting fine mesh screening that spans only a portion of the opening into a conventional gutter covering (i.e. approximately one-half ($\frac{1}{2}$) to three-fifths (3/5) the span). A different approach to this problem was attempted in U.S. Pat. No. 4,841,686 to Rees, which discloses a rain gutter assembly using a larger size mesh screen supporting a filter pad fastened in contiguous relationship beneath the screen. In this assembly, the larger size mesh screen is used as a structural stiffener and support for the filter pad, which provides a high filtering effect to prevent fine debris from passing through the assembly into the drain gutter.

SUMMARY OF THE INVENTION

An object of the present invention is to provide an improved drain gutter guard.

Another object of the present invention is to provide an improved gutter guard that is clog-proof through long periods of use.

A further object of the present invention is to provide an improved gutter guard that provides a self-cleaning action to any debris that falls or is swept onto the gutter guard by rain water or wind.

An even further object of the present invention is to provide a gutter guard that is structurally stable and can endure hard and long use with continued functioning through long periods of use.

A still further object of the present invention is to provide an improved gutter guard that is economical to construct and easy to install and maintain through long periods of use.

The present invention is directed to an improved drain gutter guard that is able to provide a number of advantages as set forth in the above objectives.

The gutter guard according to the present invention combines a fine mesh screen material with a structural stiffener. The screen material and structural stiffener can be made as separate components that can be assembled together and remain as separate components or made integral. Alternatively, the screen material and structural stiffener can be made simultaneously in a one-piece construction.

An important feature of the present invention is to provide a structural stiffener for the screen material that strengthens the screen material by reducing the span of unsupported screen material. Specifically, the structural stiffener is provided in the form of a matrix lattice that supports the screen material. The dimensions between portions of the lattice are limited to reduce the dimensions of unsupported screen material. The screen material supported in this manner provides fine mesh screening of debris from rain water while having sufficient structural strength to prevent substantial flexing or bending of the screen material under load, for example by rushing rain water, or debris temporarily settling on the mesh material prior to being washed away by rain water or blown away by wind.

The fine mesh screen used in the construction of the gutter guard according to the present invention prevents even small size debris from passing through the guard. Further, the mesh size can be selected to be sufficiently fine to somewhat prevent needle tips from entering or remaining stuck in the mesh, which could cause eventual clogging like in the prior art gutter guards. Any debris that is carried onto the guard by moving rain water will not penetrate the guard in any significant manner due to the small sized mesh and will be washed over the edge of the guard as rain water continues to flow into the gutter. Any debris that is not washed off the gutter guard will eventually dry out and be blown away by wind, since the debris will be unable to cling onto the fine mesh material. Thus, the construction of the gutter guard according to the present invention provides a self-cleaning action.

The structural stiffener according to the present invention can take on many different forms. As mentioned above, the structural stiffener is a matrix of material that limits the span of the screen material while stiffening the screen material in a direction bridging the opening into a conventional gutter. The structural stiffener supports the screen in at least one dimension (i.e. direction across gutter opening) and preferably two dimensions (i.e. plane of the gutter opening) against bending in a third dimension (i.e. direction into the gutter or direction of gravitational force). Further, the structural stiffener is designed to allow water to readily flow therethrough and not significantly impede the flow of water through the screen material that it is supporting.

The structural stiffener is preferably positioned beneath the screen material in order that the top surface of the gutter guard is as "clean" (i.e. no projections or other debris catching means) as possible to prevent any impediment to debris attaching to the upper surface of the gutter guard. As mentioned above, it is preferably to select a screen size that makes it difficult for even smaller size debris to significantly penetrate into or attach to the fine mesh screen material. Alternatively, the structural stiffener can be made integral with the screen material. However, again it is desirable the upper surface of the integral screen/stiffener assembly be as clean as possible to prevent attachment of debris.

BRIEF DESCRIPTION OF THE DRAWINGS

FIG. 1 is a perspective view of an embodiment of the gutter guard according to present invention installed on a conventional gutter on a house;

FIG. 2 is a cross-sectional view of an embodiment of the gutter guard according to the present invention installed on a conventional gutter;

FIG. 3 is a perspective view showing a two component embodiment of the gutter guard according to the present invention, separated apart for illustration purposes;

FIG. 4 is a cross-sectional view of the embodiment of the gutter guard shown in FIG. 3 when assembled;

FIG. 5 is a perspective view showing another embodiment of a gutter guard according to the present invention separated apart for illustration purposes;

FIG. 6 is a cross-sectional view of the embodiment of the gutter guard shown in FIG. 5;

FIG. 7 is a perspective view showing a further embodiment of a gutter guard according to the present invention with a connecting strip;

FIG. 8A is a cross-sectional view of the embodiment of the gutter guard shown in FIG. 5;

FIG. 8B is a perspective view showing an even further embodiment of a gutter guard according to the present invention with a connecting strip; and FIG. 9 is a perspective view showing an even still further embodiment of a gutter guard according to the present invention with a connecting strip.

DETAILED DESCRIPTION OF PREFERRED EMBODIMENTS

A gutter guard 10 according to the present invention is shown installed on a conventional drain gutter 12 mounted on a house, as shown in FIGS. 1 and 2. The gutter guard 10 extends across the opening 14 in the drain gutter 12 to prevent leaves, tree needles, bark and other common outdoor debris from entering the drain gutter 12.

As shown in FIG. 2, the gutter guard 10 is installed on the conventional drain gutter 12 with one edge 18 inserted up under shingle 16 on the house and the opposite edge 20 fitted into a bent lip portion 22 of the conventional gutter. In this installation, the connection of the gutter guard 10 with the gutter 12 is defined by the edge portion 20 being received within the curved lip portion 22 of the gutter 12 and held in place thereby. Alternatively, the gutter guard can be attached by other means such as adhesive (e.g. caulking) and/or mechanical fasteners (e.g. hooks) to different portions or surfaces of the gutter such as the upper side of the curved lip portion 22. Also, the attachment of the edge portion 18 can be made with the gutter as opposed to the shown position under shingle 16.

The gutter guard 10 can be installed so that a slight crown exists across the span of the gutter opening, which tends to keep the edge portion 20 of the gutter guard 10 firmly in place in the curved lip portion 22 of the gutter 12. Further, a slight crown shape of the gutter guard tends to keep the gutter guard free of debris.

The embodiment of the gutter guard according to the present invention shown in FIG. 3 is made of a fine mesh screen 24 supported by a structural stiffener matrix such as wire mesh 26 or plastic mesh, for example quarter inch gauge mesh. The fine mesh screen 24 is preferably plastic screen commonly used in screen windows of homes known as "insect screen" due to its inexpensive cost, however, common wire screen can also be used. For example, the fine mesh screen can be approximately $10\times10$ gauge of either metal or plastic. The wire mesh 26 is shown with a mesh size significantly greater than the mesh size of the fine mesh screen 24. However, the wire mesh 26 can have a smaller or larger mesh size than that illustrated as long as it does not substantially impede water flow therethrough and provides adequate structural support for the fine mesh screen 24.

The function of the wire mesh 26 is to stiffen the easily bendable fine mesh screen 24. The gauge and material of the wire mesh 26 is selected to provide adequate structural support for the fine mesh screen 26 in bridging the opening 14 of the gutter 12. The assembled structure should provide sufficient support to withstand the forces of substantial water flow off the roof of the house during a hard rain, and to endure transient loads exerted by debris washing over the upper surface thereof. In the even wet debris builds up on top of the gutter guard 10, it is important the gutter guard remain flat or with a crown, depending on the embodiment, as opposed to yielding and becoming concave to prevent the build up of debris over time. The wet debris will dry out and will be removed from the gutter guard by gravity, wind or reoccurring rain flow.

In a preferred embodiment, the fine mesh screen 24 is directly attached to the structural support matrix such as the wire mesh 26, as shown in FIG. 4. The fine mesh screen 24 can be attached by adhesive, mechanical fastener, or heat welded to the wire mesh 26. This attachment of the fine mesh screen 24 with the wire mesh 26 provides an integral assembly that makes it convenient to handle and easy to install. The stock material may be provided in rolls or discrete flat or bent lengths to facilitate transportation and sale thereof.

Another embodiment of a gutter guard 30 according to the present invention is shown in FIG. 5. In this embodiment, a fine mesh screen 32 is combined with a structural stiffen matrix in the form of a hexagonal matrix support 34 or honeycomb pattern. This type of structural stiffener is particularly suitable for supporting the fine mesh screen 32 by limiting the span of the fine mesh screen 32 to substantially the same span dimension in any direction within the plane of the fine mesh screen 32 due to the hexagonal geometry of the hexagonal matrix support. The hexagonal matrix material can be made from metal such as aluminum or a suitable plastic having sufficient rigidity such as nylon. In any event, the materials, particularly plastics, must be selected to endure outside weather conditions including direct sunlight, cyclic thermal variations, and contact with water and pollutants in the air.

The fine mesh screen 32 can be attached to the hexagonal matrix support. Alternatively, one or both edges of the assembly can be provide with a connector strip 36, for example made of bent and crimped aluminum, to hold the separate layers together.

A further embodiment of a gutter guard 40 is shown in FIGS. 8A and 89. In this embodiment, a layer 41 having fine mesh holes 42 is combined with a layer 44 having larger mesh holes 46.

An even further embodiment of a gutter guard 50 is shown in FIG. 9. In this embodiment, a fine mesh screen 52 is supported by a structural stiffener matrix 54 having a plurality of elongated openings 56 defining a plurality of supporting ribs 58.

EXAMPLE 1

A fine gauge fiberglass screen is bonded on the outside edge, approximately every 12 inches, to 6 inch wide and 20–25 foot long rolls of flat ¼ inch plastic/copolymer mesh forming a single guard.

EXAMPLE 2

Fine gauge aluminum screen is spot welded on the outside edge, approximately every 12 inches, to 6 inch wide and 20–25 foot long rolls of flat ¼ inch gauge aluminum wire mesh forming a single guard.

EXAMPLE 3

Short sections, for example 30–48 inches long of flat or bowed metal, aluminum or weather protected steel alloys, ¼ inch screen wire mesh are covered with brite or subdued fine screen wire forming manageable sections of guard.

EXAMPLE 4

Affixing 6 inch wide strips of fine vinyl screen to short sections of vinyl gutter screen.

METHOD OF MAKING

The gutter guard according to the present invention can be made by combining a layer of fine mesh screen with a support matrix such as larger mesh screen. The stock materials can be provided in roll form and combined together by means of guiding rollers to place the fine mesh screen in contact with the larger mesh screen. An adhesive can be applied between the screen layers prior to contact, or some other means of attachment can be made before or after the step of combining the screen layers.

I claim:

1. A drain gutter guard for a drain gutter having an upper opening, said guard comprising:

a fine mesh screen for substantially preventing penetration of debris into or through said fine mesh screen, said fine mesh screen having a size and configuration to cover at least a portion of the opening into the drain gutter, said fine mesh screen being substantially flexible so that said fine mesh screen can be configured in roll form;

a self-supporting one-piece structural stiffener matrix having uniform size and shaped openings positioned below and directly connected throughout the extent of the drain gutter guard to said fine mesh screen for supporting said fine mesh screen against bending when loaded by rain water debris and allowing water to readily penetrate therethrough, said self-supporting one-piece structural stiffener being substantially flexible so that said fine mesh screen can be configured in roll form, said fine mesh screen and said self-supporting one-piece structural stiffener being connected together in a manner so that the drain gutter guard can be configured in roll form; and a connector portion associated with at least one of said fine mesh screen and said structural stiffener matrix for installing the guard to the drain gutter at the opening thereof.

2. A guard according to claim 1, wherein said fine mesh screen and said structural stiffener matrix are made integral with each other.

3. A guard according to claim 1, wherein said structural stiffener matrix is defined by a stiffener screen having a structural strength against bending greater than said fine mesh screen.

4. A guard according to claim 3, wherein said structural stiffener matrix has a larger mesh size than said fine mesh screen.

5. A guard according to claim 1, wherein said structural stiffener matrix provides increased bending strength to said fine mesh screen in a least one dimension of said fine mesh screen.

6. A guard according to claim 1, wherein said stiffener matrix provides increased bending strength to said fine mesh screen in both dimensions of said fine mesh screen.

7. A guard according to claim 1, wherein said fine mesh screen is made of one selected from the group of plastic, aluminum, steel, stainless steel, bronze and brass.

8. A guard according to claim 1, wherein said structural stiffener matrix is made of hexagonal matrix support material.

9. A guard according to claim 1, wherein said structural stiffener matrix is made of support material having a matrix of holes therethrough.

10. A guard according to claim 1, wherein said structural stiffener matrix is made of support material having a plurality of set apart ribs set in a direction bridging the opening of the gutter.

11. A guard according to claim 1, wherein said fine mesh screen is provided with holes having a shape selected from to group of squares, circles, triangles, hexagons and stars.

12. A drain gutter guard according to claim 1, wherein longitudinal edges of said assembly are unsupported by any additional structural stiffener other than said structural stiffener matrix, and is configured to install with one longitudinal edge received within a curved lip portion of the drain gutter, and an opposite longitudinal edge slipped between shingles and roof of a building on which the drain gutter is installed.

* * * * *